United States Patent [19]

Stoneberg

[11] 4,125,153

[45] Nov. 14, 1978

[54] HEAT EXCHANGER

[76] Inventor: James H. Stoneberg, R.D. #1, Brockport, Pa. 15823

[21] Appl. No.: 670,570

[22] Filed: Mar. 25, 1976

[51] Int. Cl.[2] ..... F28F 3/08

[52] U.S. Cl. ..... 165/166

[58] Field of Search ..... 165/157, 165, 166

[56] References Cited

U.S. PATENT DOCUMENTS

| | | | |
|---|---|---|---|
| 1,825,498 | 9/1931 | Wogan | 165/165 |
| 2,143,269 | 1/1939 | Hubbard | 165/166 |
| 2,368,814 | 2/1945 | Fagan | 165/166 |
| 3,311,166 | 3/1967 | Southlam | 165/166 |

FOREIGN PATENT DOCUMENTS

| | | | |
|---|---|---|---|
| 580,039 | 10/1924 | France | 165/166 |

*Primary Examiner*—Charles J. Myhre
*Assistant Examiner*—Theophil W. Streule, Jr.
*Attorney, Agent, or Firm*—Clarence A. O'Brien; Harvey B. Jacobson

[57] ABSTRACT

A parallelopiped is provided defining relatively isolated side-by-side alternate right angularly disposed passages extending therethrough and with the opposite ends of the first and second sets of corresponding passages opening through first and second pairs of opposite sides of the parallelopiped disposed between the third pair of opposite sides thereof. First and second pairs of tubular fittings including one set of corresponding ends of generally rectangular cross section have those ends secured to the first and second pairs of opposite sides of the parallelopiped with the corresponding ends of the passages opening into the rectangular cross section ends of the fittings.

6 Claims, 4 Drawing Figures

HEAT EXCHANGER

BACKGROUND OF THE INVENTION

Various forms of cross-flow heat exchangers have been known in the past, but most have been constructed of numerous different parts and have been difficult to assemble. Examples of structures of this type and including some of the basic structure of the instant invention are disclosed in U.S. Pat. No. 2,093,968, French Pat. No. 580,039 and French Pat. Addition No. 29,315.

BRIEF DESCRIPTION OF THE INVENTION

This invention primarily relates to a novel heat exchanger structure and more particularly to a heat exchanger of the cross-flow type.

It is a primary object of this invention to simplify the construction of a heat exchanger of the cross-flow type and to provide one which is highly efficient in operation.

A further object of this invention comprises the elimination of the use of welding in the heat exchanger construction which produces warpage and is usually limited to certain types and thicknesses of metal which do not comprise the best metals through which heat exchange can be accomplished.

Accordingly, another object of this invention is to provide a heat exchanger of the cross-flow type which may be fabricated from thin metal plates and strengthened by means of bracing elements which are not welded to said plates to effect a high rate of heat exchange between hot and cold gases flowing in right angular paths across the top and bottom surfaces of said plates.

A further object of this invention in accordance with the preceding object specified is the provision of a heat exchanger comprising a plurality of baffle plates which limit the direction of flow of hot and cold gases and which may be slidably assembled and disassembled with comparative ease for repair and cleaning purposes.

Yet another object of this invention resides in the novel means for connecting a plurality of the aforementioned baffle plates and rigidly holding them in joined relationship to present a heat exchanger structure presenting alternate perpendicular gas conduits.

A still further object of this invention resides in the structure of the heat exchanger wherein a plurality of fittings may be rapidly connected to opposed surfaces of the cross-flow heat exchanger to readily supply the hot and cold gases thereto.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
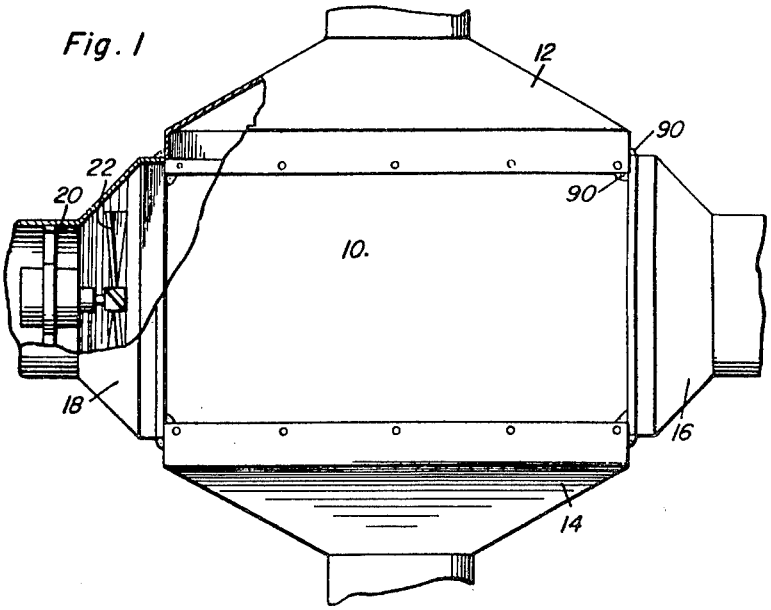
FIG. 1 is a top plan view of the completed cross-flow heat exchanger with gas conducting fittings shown attached thereto and portions thereof broken away to illustrate certain details of the structure.

Referring now to the drawings in detail, the heat exchanger of the present invention is of the cross-flow type wherein a plurality of openings are formed in one side of the heat exchanger structure to permit the flow of hot gases therethrough. The heat exchanger is further provided with passages at right angles relative to the hot gas passages and interspaced therebetween wherein a forced flow of cooled gas is adapted to flow through the exchanger and heat exchange takes place between the hot and cooled gases through metallic spacer plates which define the limits of the aforementioned passages. As shown in FIG. 1, the heat exchanger structure is generally designated by the numeral 10 and has attached thereto at opposite sides thereof a first pair of fittings 12 and 14 which act as conduits for heated gases coming from a furnace and which pass through the heat exchanger 10 and into the opposite fitting which conducts this gas after the heat has been removed therefrom to a chimney flue or the like. A second pair of fittings 16 and 18 cooperate with the heat exchanger 10 to conduct forced cool air through the heat exchanger which gases are heated therein and are then conducted by an opposite fitting to heating pipes in one's home or office or the like. As shown in the fitting 18 a suitable bracket 20 may mount a motor-driven fan such as 22 to either pull cool air from the conduit 16 or to blow heated air thereto whichever may be the case.

Figure 4:
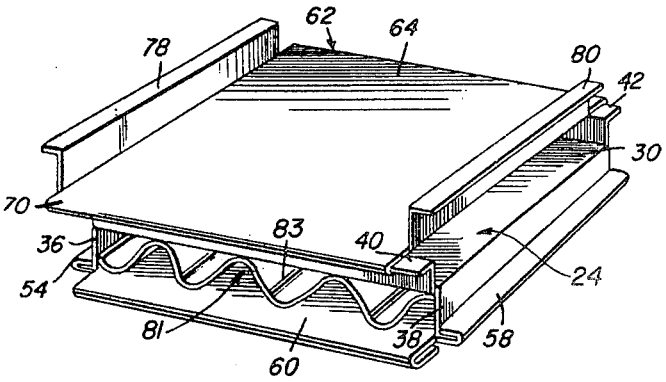
FIG. 4 is a perspective view of an intermediate step in the formation of the heat exchanger and further illustrating certain fin elements which are utilized in the structure to strengthen it and uniformly distribute the flow of gas therethrough.
Figure 2:
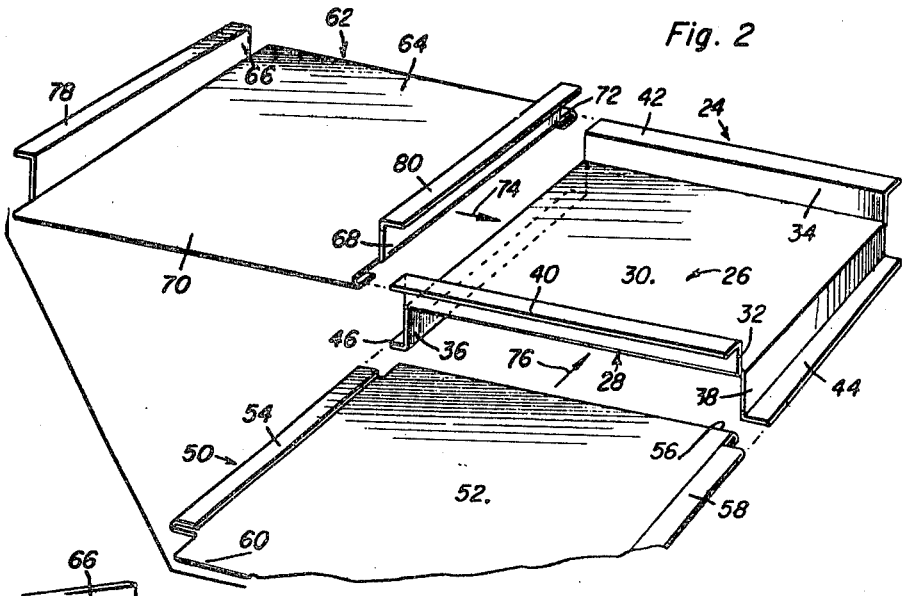
FIG. 2 is a partial perspective view illustrating the mode of assembly of the baffle plates utilized to form the cross-flow heat exchanger of the present invention.

As hereinbefore mentioned, the heat exchanger structure 10 is made up of a plurality of baffle plates which when assembled form a plurality of relatively right angular passages through which the gases between which the heat exchange takes place are forced. Referring to FIGS. 2 and 4, a typical baffle plate is exemplified by the numeral 24 and comprises a top channel section 26 and a lower channel section 28 having a common web 30. As shown in said Figures, the top and bottom channel sections 26 and 28 open in right angularly disposed directions and have confining flanges 32, 34 and 36, 38 defining gas passages or entrances which are at right angles to each other. Each of the flanges 32, 34, 36 and 38 have laterally extending extensions such as shown at 40, 42, 44 and 46, for the purposes hereinafter specified.

Figure 3:
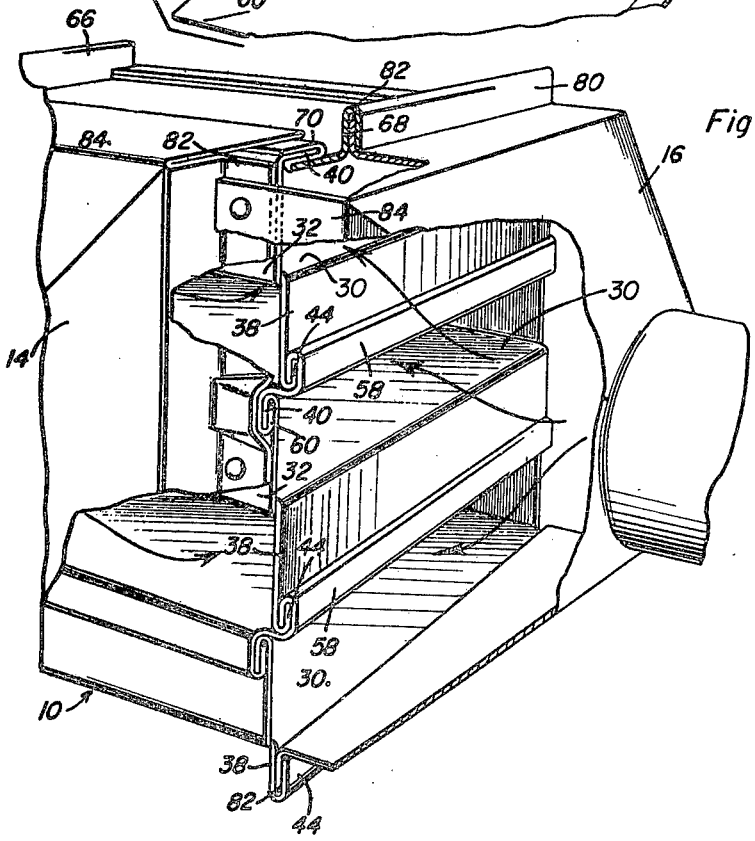
FIG. 3 is a partial perspective view of the completed heat exchanger structure showing the gas conducting fittings attached thereto with parts broken away to show the internal structure of the heat exchanger.

The baffle plates 24 are connected together to form a stacked structure as shown in FIG. 3 of a heat exchanger having alternate right angular passages therein. Spacer plates generally indicated by the numeral 50 are provided between each of adjacent baffle plates 24 to rigidly connect the baffle plates together and to clearly delineate adjacent transverse passage in the exchanger structure. Each spacer plate 50 comprise a flat body member 52 which has laterally extending U or reversely bent extensions 54, 56, 58 and 60 defining narrow opposite side channels extending along pairs of opposite side marginal edges of the plate 50 opening toward each other on opposite sides of the medial plane of the plate 50. It should be noted that the extensions 54 and 58 are bent upwardly while the extensions 60 and 56 are bent downwardly for the purpose which will hereinafter be specified.

The top plate of the structure comprises a special plate designated by the numeral 62 and in fact is a hybrid of the baffle plate 24 and the spacer plate 50 in that it comprises an upwardly opening channel section including a web 64 and side flanges 66 and 68. Opposite edges of the web 64 include reversely bent or U-shaped extensions 70 and 72 which are downwardly bent. It should be appreciated from FIGS. 2 and 4 that the plates 62, 24, and 50 may be slidably assembled to form the requisite heat exchanger structure as indicated by the arrows 74 and 76 in FIG. 2. That is, the laterally extending flanges 40, 42 of the baffle plate 24 may be telescopically received within the U-shaped extensions 70, 72 of the special plate 62. Furthermore, the lateral flange extensions 44 and 46 of the baffle plate 24 may be telescopically received within the upwardly bent extensions 54 and 58 of the spacer plate 50. This completed structure is illustrated in FIG. 4. Then, another baffle plate 24 may have its laterally extending flanges 40, 42 slid into the remaining downwardly bent U-shaped extensions 56, 60 of the spacer plate 50 and then another spacer plate may be slid on the flanges 46, 44 of said second baffle plate 24 and so on until the desired size of the heat exchanger structure is realized. The bottommost plate of the heat exchanger structure should comprise baffle plate 24 so that laterally extending flanges 44 and 46 on said bottom plate will be parallel to the laterally extending flanges 78 and 80 on the topmost special plate 62, for the purpose described below.

It should be appreciated that for the best heat exchange between gases flowing through the passages formed by the web 30 of the baffle plate 24 and the web 64 of the top plate 62 and the body 52 of the spacer member and the web 30 of the baffle plate 24, the webs 30, 64 and body member 52 should be of the thinnest possible metal. In order to increase the strength of said plates therefore, one may insert a fin member such as shown at 81 in each of said passages. The fin member 81 is of a slightly greater width than the width of the passageway into which it is inserted and comprises corrugations 83 formed therein whereby the fin member 81 may be compressed and inserted into the passageway wherein it will spring back and be firmly held between the side flanges of said passageway. Furthermore, the corrugations are so formed as to effectively divide the passageway in half and to deflect gases flowing through the passageway towards the top and bottom plates covering said passage. In this manner, an effective mode of heat exchange can be readily accomplished while further strengthening the thin baffle plates which are contemplated by the present invention.

Referring now to FIG. 3, it will be appreciated that the aforementioned plates may be formed into a rigid heat exchanger structure. As illustrated in said Figure, the interjoined flange extensions 40 and 70 and 42 and 64 are bent upwardly to lie flush on the web portion of the top separate plate 62. The laterally extending flanges 58 and 44 and 54 and 46 which are slidably telescoped together are then bent upwardly while the flanges 60 and 56 of the spacer plate telescopically receive laterally extending flanges 40 and 42 of a second baffle plate 24 and these mating joints are bent downwardly as shown in said Figure. This process is repeated until the exchanger is complete thus forming a cross-flow heat exchanger the plates of which are rigidly joined together without the necessity of welding or other warpage inducing joining methods or the like. As specified above, the completed heat exchanger portion 10 terminates in two plates having parallel flange extensions. Fittings 16 and 18 are attached to the exchanger by means of an upstanding flange 82 formed at either end of the fitting which is set flush against the flanges 68, 38 and 66, 36 of the top and bottom plates respectively. Then the laterally extending portions 80 and 44 are bent over to encompass the flanges 82 on the heat exchanger fitting 16 and likewise the flange extensions 78 and 46 are bent over the flange 82 of the fitting 18. Bolts or rivets may be extended through these corresponding mating flanges to rigidly hold the fittings to the heat exchanger structure. It should be noted that the fittings 16 and 18 are formed with upstanding inwardly extending side flange 84. The fittings 12 and 14 are identical to the fittings 16 and 18 but are placed perpendicular thereto in a position rotated ninety degrees to the orientation of the fittings 16 and 18. In such case the flanges 84 of the fittings 12 and 14 extend over the joint formed by the intertwined flanges 40 and 70 and may be riveted thereto and the flange 84 at the bottom of the fittings 12 and 14 may be riveted or bolted to the last web 30 of the bottom baffle plate 24. The flanges 82 of the fittings 12 and 14 may be riveted or bolted to the inwardly extending flanges 84 of the fittings 16 and 18. To complete the heat exchanger structure, the juncture of the flanges 84 of the fittings 16 and 18 with the flanges 82 of the fittings 12 and 14 may be caulked to the exchanger at the interior and exterior of the seam as shown at 90 in FIG. 1. This insures that there is no leakage from the gas conducting passages of the heat exchanger structure 10.

It should now be appreciated that a simple and efficient structure has been provided for constructing a highly desirable heat exchanger. As noted, the resultant structure presents a plurality of alternately spaced perpendicular transverse passages through the exchanger whereby heat may be exchanged through the webs 30 of the baffle plates 24 and the body members 52 of the spacer plates 50. The flow of gases is strictly confined thereby rendering the loss of heat at a minimum. Furthermore, due to this novel construction, the webs 30 and the body members 52 may be made from thin members to thereby give a high rate of heat exchange and they may be braced by a suitable fin such as 81. It should also be appreciated that the formation of the joints between each separate plate renders an effective and foolproof method of forming the requisite stack structure.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

What is claimed as new is as follows:

1. A cross-flow heat exchanger including a plurality of laterally spaced generally parallel first rectangular baffle plates having first and second pairs of opposite side marginal edges with the first pair of marginal edges of each plate disposed at generally right angles relative to the second pair of corresponding marginal edges of that plate, the first and second pairs of said edges including oppositely directed right angularly disposed side flanges extending therealong and terminating outwardly in oppositely outwardly directed right angularly disposed flange extensions, a generally rectangular divider plate disposed between each pair of adjacent first plates, said divider plate including first and second pairs of opposite side marginal edges, the last mentioned pairs of marginal edges including oppositely sharply reversely bent portions defining narrow opposite side channels extending along pairs of opposite side marginal edges of said plate opening toward each other and disposed on opposite sides of the medial plane of said plate, the pairs of opposite side channels of said divider plate snugly and slidably receiving the adjacent flange extensions of the adjacent baffle plates therein, thereby defining a parallelopiped having isolated side-by-side alternate generally right angularly disposed passages extending therethrough and whose opposite ends open outwardly through the four sides of said parallelopiped disposed between one pair of opposite sides thereof, and first and second pairs of tubular fittings including one set of corresponding ends of generally rectangular cross section, said one set of ends of said fittings being supported from said four sides.

2. The combination of claim 1 wherein said fittings are identical and said first pair of fittings are rotated 90° about the center lines of the corresponding passages relative to the second pair of fittings.

3. The combination of claim 2 wherein the other set of corresponding ends of said fittings are cylindrical and generally coaxial with said center lines.

4. The combination of claim 1 including a closure plate extending between and supported from the extension flanges of one first plates projecting outwardly from one of said one pair of opposite sides of said parallelopiped and defining a further passage extending through said parallelopiped between the corresponding side flanges, the opposite ends of said further passage opening into the rectangular ends of the fittings disposed on the remote sides of said parallelopiped through which the opposite ends of said further passage open.

5. The combination of claim 4 wherein said fittings are identical and said first pair of fittings are rotated 90 degrees about the center lines of the corresponding passages relative to the second pair of fittings.

6. The combination of claim 5 wherein one pair of opposite edges of the rectangular end of each fitting include laterally outwardly directed edge flanges and the other pair of opposite edges of the rectangular end of each fitting include extension flanges extending therealong projecting in the direction in which said rectangular end opens, the extension flanges of one pair of opposite fittings overlapping the edge flanges of the other pair of opposite fittings.

* * * * *